US006666266B2

(12) United States Patent
Starr et al.

(10) Patent No.: US 6,666,266 B2
(45) Date of Patent: Dec. 23, 2003

(54) SCREW-DRIVEN WELLHEAD ISOLATION TOOL

(75) Inventors: Phillip M. Starr, Duncan, OK (US); Don S. Folds, Duncan, OK (US); Lee Wayne Stepp, Comanche, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 10/138,544

(22) Filed: May 3, 2002

(65) Prior Publication Data

US 2003/0205373 A1 Nov. 6, 2003

(51) Int. Cl.[7] ..... E21B 19/00
(52) U.S. Cl. ..... 166/90.1; 166/85.4; 166/77.51
(58) Field of Search ..... 166/90.1, 70, 72, 166/77.4, 84.5, 85.4, 77.51, 85.1, 97.1

(56) References Cited

U.S. PATENT DOCUMENTS

| | | | | | |
|---|---|---|---|---|---|
| 3,830,304 | A | * | 8/1974 | Cummins | 166/305.1 |
| 4,023,814 | A | | 5/1977 | Pitts | 277/181 |
| 4,111,261 | A | | 9/1978 | Oliver | 166/86 |
| 4,262,743 | A | | 4/1981 | Surjaatmadja | 166/91 |
| 4,315,543 | A | | 2/1982 | Luers et al. | 166/202 |
| 4,341,264 | A | | 7/1982 | Cox et al. | 166/55 |
| 4,487,025 | A | | 12/1984 | Hamid | 62/54 |
| 4,612,984 | A | | 9/1986 | Crawford | 166/77 |
| 4,657,075 | A | | 4/1987 | McLeod | 166/72 |
| 4,682,657 | A | | 7/1987 | Crawford | 166/385 |
| 4,691,770 | A | | 9/1987 | McLeod | 166/73 |
| 4,867,243 | A | | 9/1989 | Garner et al. | 66/379 |
| 4,991,650 | A | | 2/1991 | McLeod | 166/72 |
| 4,993,488 | A | | 2/1991 | McLeod | 166/72 |
| 4,993,489 | A | | 2/1991 | McLeod | 166/72 |
| 5,012,865 | A | | 5/1991 | McLeod | 166/90 |
| 5,025,857 | A | | 6/1991 | McLeod | 166/77 |
| 5,060,723 | A | | 10/1991 | Sutherland et al. | 166/202 |
| 5,113,936 | A | | 5/1992 | Sutherland | 166/85 |
| 5,261,487 | A | | 11/1993 | McLeod et al. | 166/77 |
| 5,285,852 | A | | 2/1994 | McLeod | 166/379 |
| 5,332,044 | A | | 7/1994 | Dallas et al. | 166/386 |
| 5,372,202 | A | | 12/1994 | Dallas | 166/386 |
| 5,396,956 | A | | 3/1995 | Cherewyk et al. | 166/250 |
| 5,429,191 | A | | 7/1995 | Schmidt et al. | 166/297 |
| 5,540,282 | A | | 7/1996 | Dallas | 166/379 |
| 5,605,194 | A | | 2/1997 | Smith | 166/382 |
| 5,615,739 | A | | 4/1997 | Dallas | 166/306 |
| 5,785,121 | A | | 7/1998 | Dallas | 166/90.1 |
| 5,819,851 | A | | 10/1998 | Dallas | 166/308 |
| 5,890,541 | A | | 4/1999 | Jennings et al. | 166/336 |
| 5,927,403 | A | | 7/1999 | Dallas | 166/77.51 |
| 5,975,211 | A | | 11/1999 | Harris | 166/379 |
| 6,009,941 | A | | 1/2000 | Haynes | 166/72 |
| 6,039,120 | A | | 3/2000 | Wilkins et al. | 166/368 |
| 6,145,596 | A | | 11/2000 | Dallas | 166/379 |
| 6,176,310 | B1 | | 1/2001 | Smith et al. | 166/89.1 |
| 6,179,053 | B1 | | 1/2001 | Dallas | 166/77.51 |
| 6,220,363 | B1 | | 4/2001 | Dallas | 166/382 |
| 6,234,253 | B1 | | 5/2001 | Dallas | 166/377 |
| 6,289,993 | B1 | * | 9/2001 | Dallas | 166/386 |
| 6,364,024 | B1 | * | 4/2002 | Dallas | 166/379 |
| 6,447,021 | B1 | * | 9/2002 | Haynes | 285/302 |
| 6,557,629 | B2 | * | 5/2003 | Wong et al. | 166/76.1 |

FOREIGN PATENT DOCUMENTS

| | | |
|---|---|---|
| EP | 0 572 732 B1 | 8/1998 |

* cited by examiner

*Primary Examiner*—Roger Schoeppel
(74) *Attorney, Agent, or Firm*—John W. Wustenberg; Anthony L. Rahhal

(57) ABSTRACT

A wellhead isolation tool comprises a threaded drive rod coaxially aligned with a tubular mandrel having a smooth outer surface. A motor displaces the threaded drive rod vertically without rotating the drive rod to move the tubular mandrel through a wellhead into a tubular element in a well. The lower end of the tubular mandrel will sealingly engage the tubular element in the well so that treating fluids or other substances such as, but not limited to, chemicals and erosive flows, can be displaced therethrough at high pressures into the well to fracture or otherwise treat the well without damaging the wellhead.

50 Claims, 16 Drawing Sheets

SCREW-DRIVEN WELLHEAD ISOLATION TOOL

BACKGROUND OF THE INVENTION

The present invention relates to wellhead equipment, and more particularly to a wellhead isolation tool for isolating a wellhead from the high pressures and the abrasive and/or caustic substances used in well treatment procedures.

It is not unusual for oil and gas wells to require stimulation to restart, or to improve, a flow of hydrocarbons from a hydrocarbon bearing formation. Such stimulation typically involves pumping fluid mixtures into the formation at high pressures. Such fluid mixtures often comprise acidic solutions and/or proppants that can be caustic and/or abrasive. Hydraulic fracturing, one common form of stimulating a hydrocarbon bearing formation, forces liquids and/or gasses which may include proppants or other abrasives therein into the formation. Extremely high pressures and high flow rates must be employed in the hydraulic fracturing process so that the proppants will be forced into the hydrocarbon bearing formation.

Conventional wellheads, commonly called well trees, are not generally designed to withstand the pressures and/or the abrasive or caustic nature of the substances required to stimulate a formation. Generally, the wellhead is designed to withstand pressures of less than about 5,000 psi. The substances utilized to stimulate the formation will be pumped into the well at pressures greatly exceeding 5,000 psi and may be as much as 20,000 psi.

There are a number of existing wellhead isolation tools that provide for the reciprocation of a mandrel through the wellhead into the well so that the substance utilized to stimulate the well passes through the mandrel and into the well without damaging the wellhead. However, because of the potentially dangerous nature of the well stimulation operation, there is a continuing need to provide a wellhead isolation tool which can be easily connected to the wellhead and disconnected therefrom, which provides easy access for connection of lines to supply the treatment fluid, and which provides an efficient and safe method to stimulate the hydrocarbon bearing formation.

SUMMARY OF THE INVENTION

The present invention is directed to a wellhead isolation tool for injecting substances through a wellhead into a tubular element, such as a production tubing, in a well. The wellhead isolation tool includes a tubular mandrel adapted to be received through a longitudinal passage defined by the wellhead. The tubular mandrel defines a mandrel flow passage and has a nonthreaded outer surface.

The wellhead isolation tool further includes at least one high pressure valve connected to an upper end of the tubular mandrel. Treatment substances such as fracturing fluids containing proppants and other treatment fluids may be communicated through the high pressure valve into the mandrel flow passage when the at least one high pressure valve is in an open position. The tubular mandrel has an upper position in which the mandrel does not extend through the wellhead into the well and a lower position in which a lower end of the mandrel is sealingly received in the production tubing in the well. A threaded drive rod for reciprocating the tubular mandrel is vertically aligned with the tubular mandrel and is connected to the at least one valve.

The wellhead isolation tool further includes a drive mechanism for vertically displacing the threaded rod to urge the tubular mandrel downward through the wellhead and into the tubular element in the well. Once the tubular mandrel is sealingly engaged in the well, treatment fluids can be flowed into the well at extremely high pressures through the tubular mandrel without damaging the wellhead. The wellhead isolation tool further includes a support structure which provides for the easy location and connection of the wellhead isolation tool to the wellhead.

BRIEF DESCRIPTION OF THE DRAWINGS

FIG. 6 is a top view of a wellhead adapter sub of the present invention.

FIG. 8 shows the lower end of the mandrel of the present invention sealingly engaged in production tubing in the well.

FIG. 16 is a right-side elevation view of the support structure of FIG. 14.

DETAILED DESCRIPTION OF A PREFERRED EMBODIMENT

Figure 1:
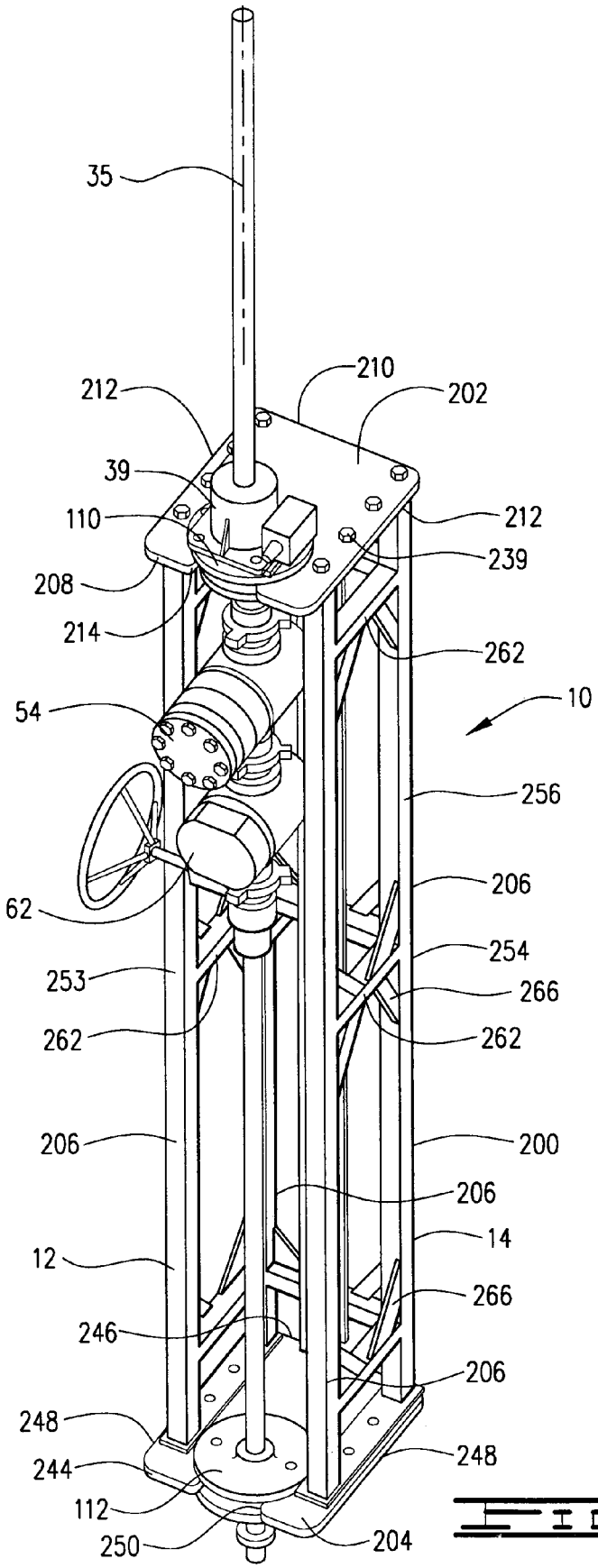
FIG. 1 is perspective view of the wellhead isolation tool of the present invention.
Figure 2A:
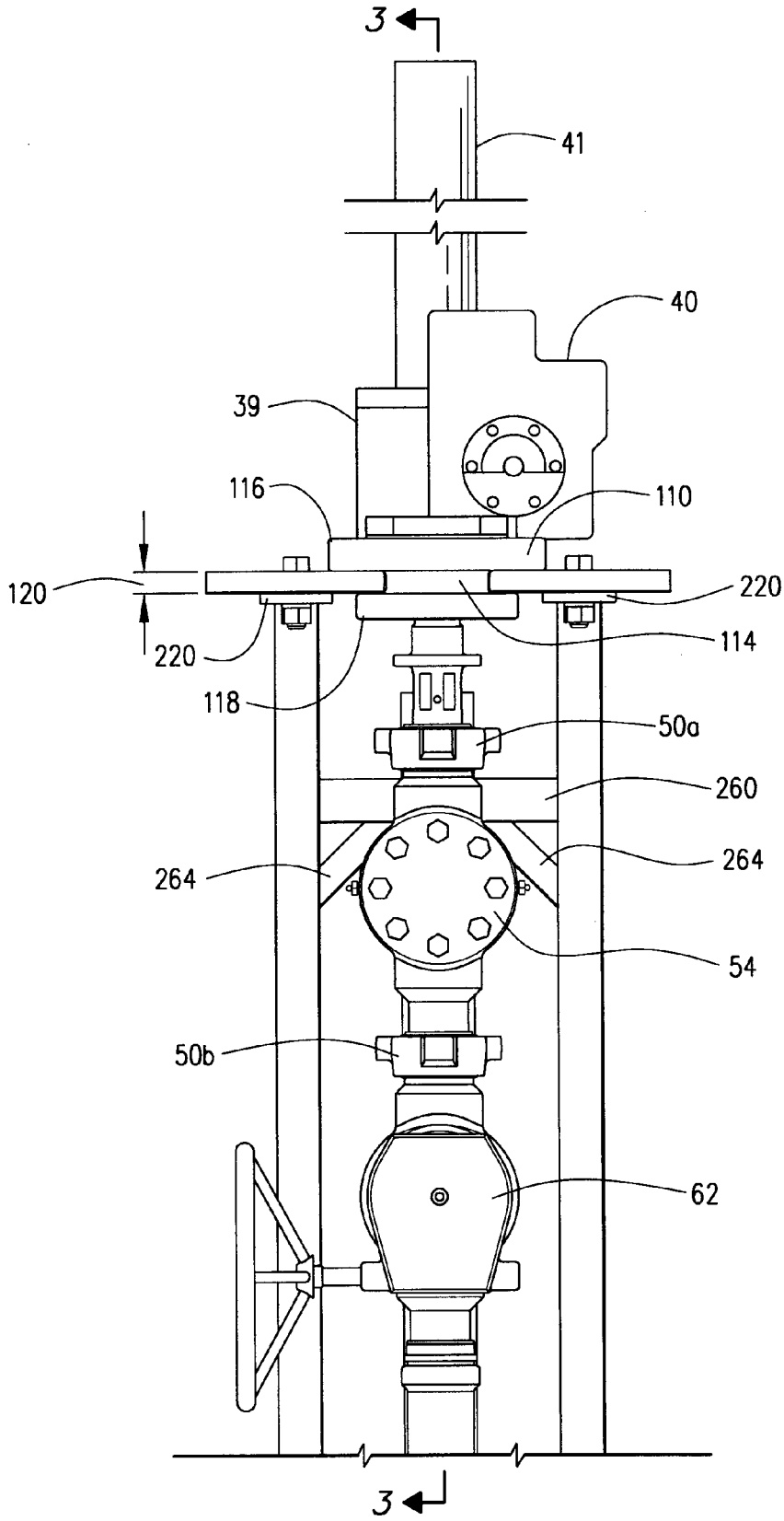
FIGS. 2A–2C show a front elevational view of the wellhead isolation tool of the present invention.
Figure 2B:
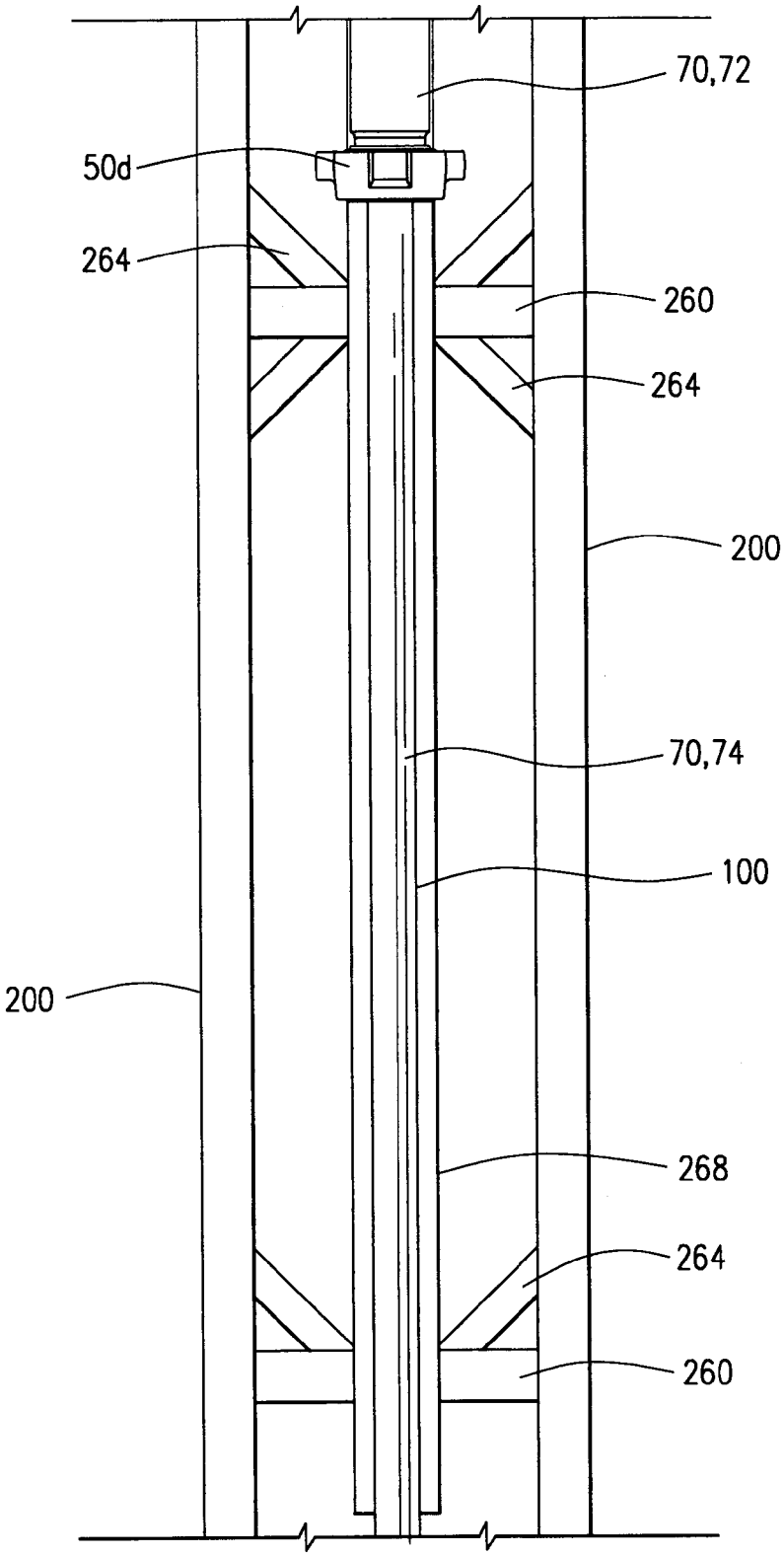
Figure 2C:
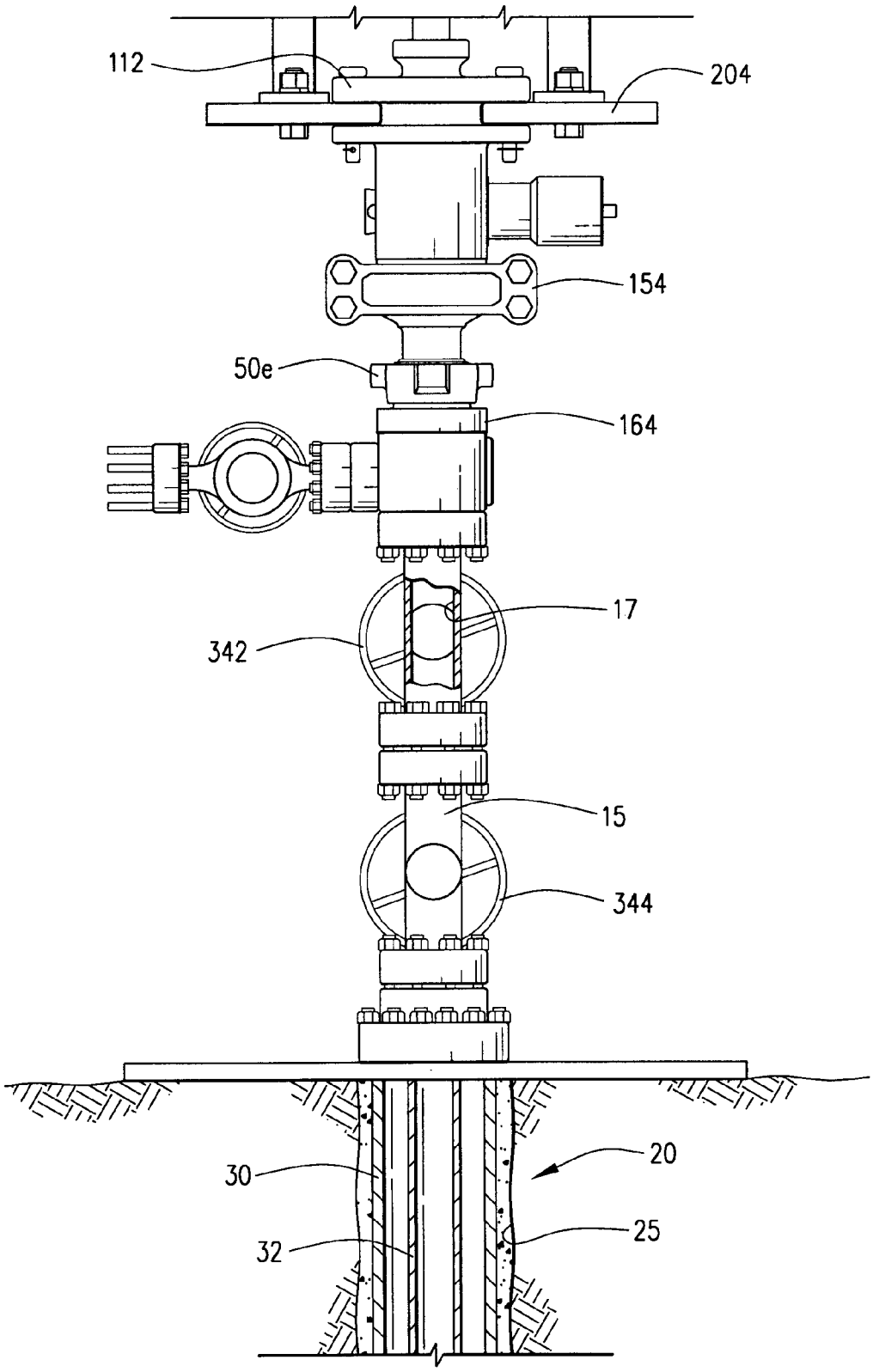
Figure 3A:
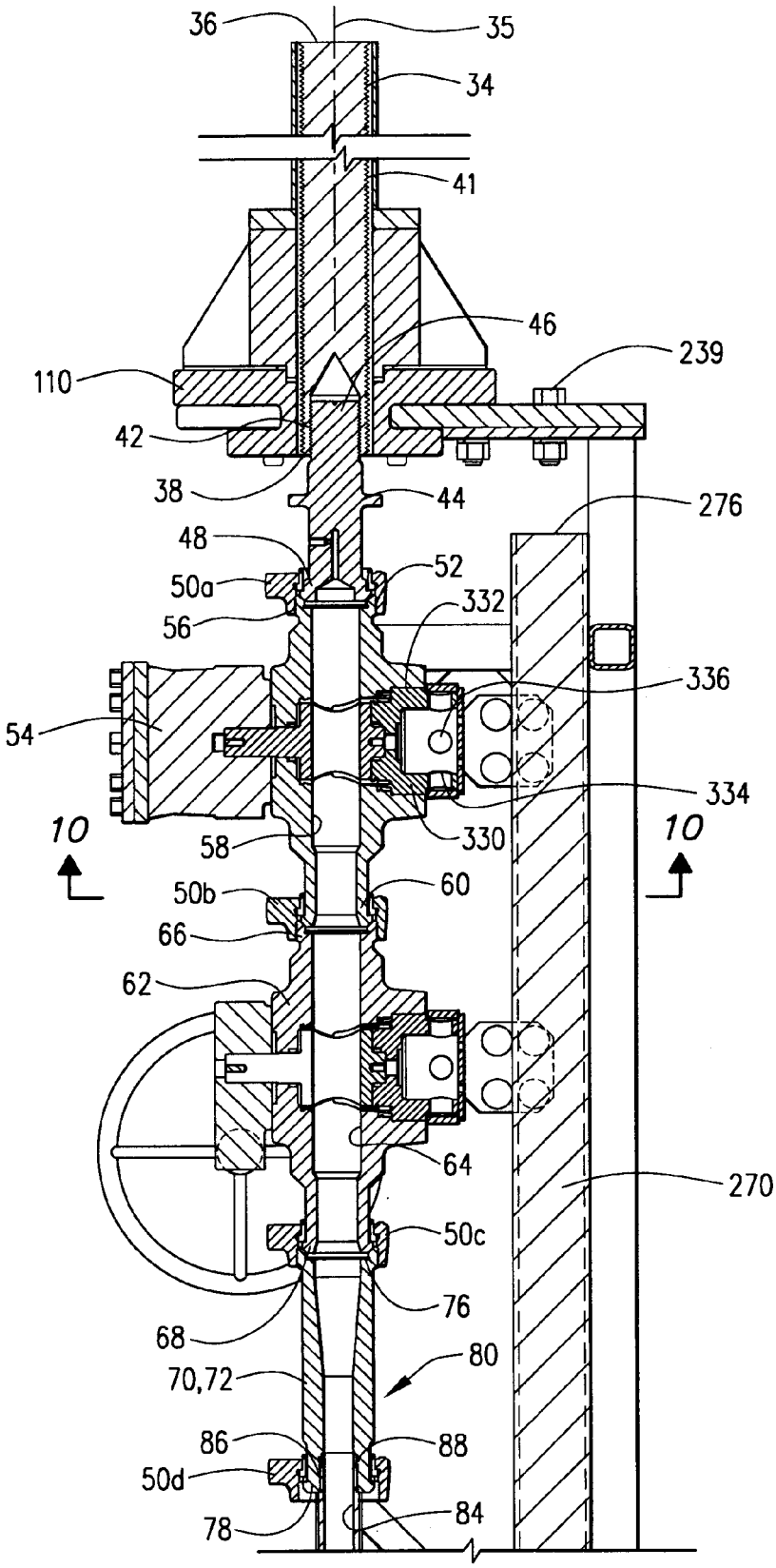
FIGS. 3A–3B show a cross section of the wellhead taken from line 3—3 of FIGS. 2A–2C.
Figure 3B:
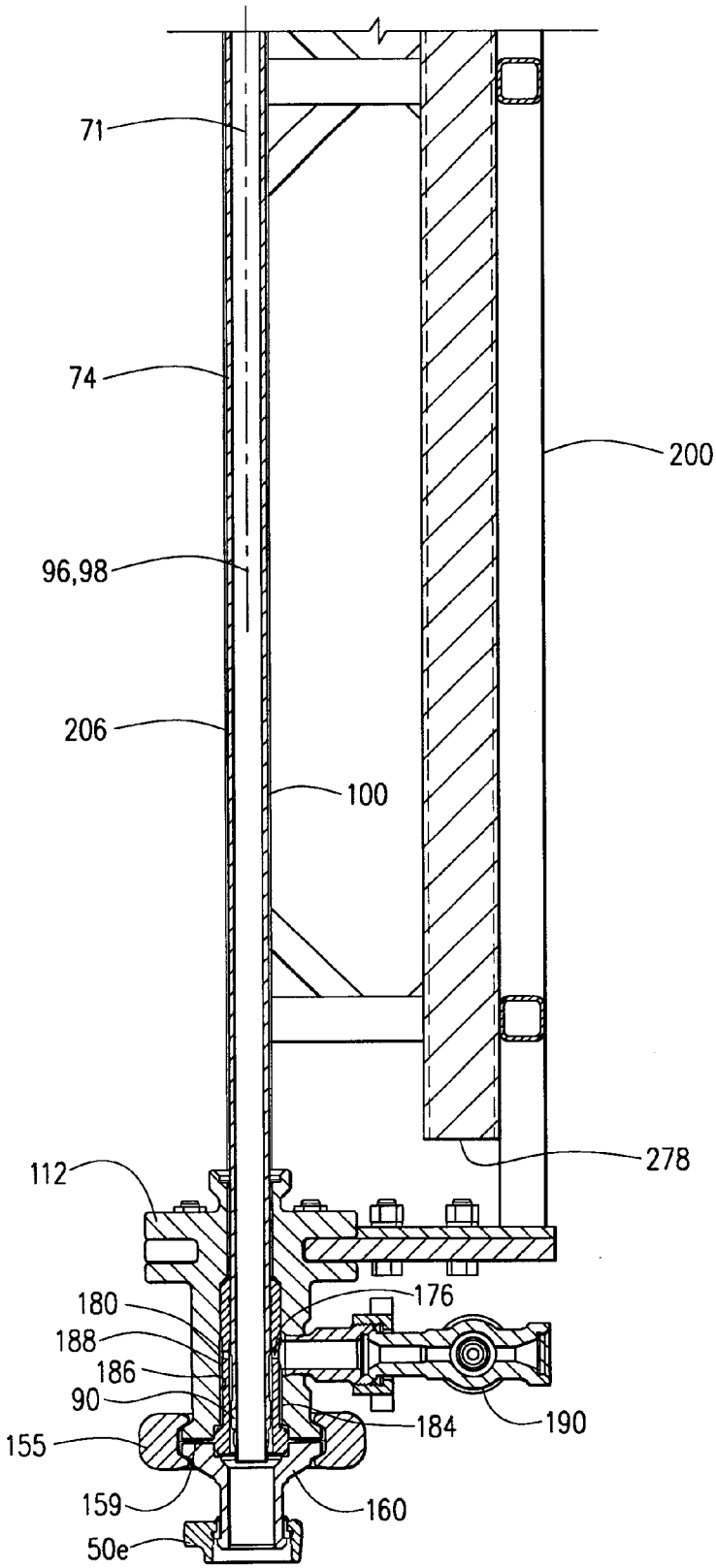

Referring now to the drawings and more particularly to FIGS. 1–3, a wellhead isolation tool designated by the number 10 is shown. Wellhead isolation tool 10 has a front 12 and a rear 14. FIG. 2C shows wellhead isolation tool 10 connected to a wellhead 15 defining a longitudinal passage 17, positioned over a well 20. Well 20 may comprise a wellbore 25 having a casing 30 cemented therein. Well 20 has a tubular element, which may be a production tubing 32 disposed therein.

Wellhead isolation tool 10 comprises a drive rod 34 which is preferably an externally threaded drive rod. Drive rod 34 preferably has a regular screw thread on the exterior thereof. Drive rod 34 has a longitudinal central axis 35, an upper end 36 and a lower end 38. As will be explained in more detail herein, drive rod 34 may be moved vertically by a type of screw drive mechanism. For example, a machine screwjack 39 driven by a motor 40 of a type known in the art may be utilized. The details of each are not depicted, but are shown schematically in the figures. Motor 40 is not shown in FIG. 1, but is schematically represented in FIG. 2. Screwjack 39 may be, for example, a machine screwjack model 50 MSJ, available from Nook Industries, Inc. An outer protective tube 41 may be disposed about drive rod 34 above screwjack 39. Drive rod 34 has internal threads 42 at the lower end 38 thereof. A coupling 44 is threadedly connected at its upper end 46 to drive rod 34 at internal threads 42. Coupling 44 has a lower end 48 with a wing nut assembly 50*a* disposed thereabout. Wing nut assembly 50*a* is connected at a threaded connection 52 to a valve 54 which may be referred to as an upper valve 54. Wing nut assembly 50*a* is connected to upper valve 54 at the upper end 56 thereof. Drive rod 34 is thus connected to upper valve 54 with coupling 44 and wing nut assembly 50*a*. As will be explained in more detail hereinbelow, wing nut assembly 50*a* may be easily disconnected from upper valve 54 so that a fluid line may be connected thereto. Upper valve 54 is depicted as a remote control valve which is movable between open and closed positions. In the open position, fluid may be displaced through a passage 58, and in the closed position no fluid is allowed to pass therethrough.

Upper valve 54 has a lower end 60. A wing nut assembly 50*b* is disposed about the lower end 60 of upper valve 54, and connects upper valve 54 with a lower valve 62. There are a plurality of wing nuts 50 utilized with the wellhead isolation tool 10. Wing nuts 50 are referred to as wing nuts, or wing nut assemblies 50*a*–50*e* for ease of identification. Wing nuts 50*a*–50*e* may be identical to one another.

Lower valve 62 is depicted as a manually operated valve which defines a passage 64. Lower valve 62 is movable between an open position wherein fluid may be displaced through passage 64 and a closed position wherein fluid flow therethrough is prevented. Although the wellhead isolation tool 10 of the present invention shows two valves, namely upper and lower valves 54 and 62, respectively, it is understood that wellhead isolation tool 10 will have at least one valve and preferably a plurality of valves. In the embodiment shown, a remote control valve is shown as upper valve 54 and a manually operated valve is shown for lower valve 62. The positions of the valves may be switched or both may be manual or remote control.

Figure 4A:
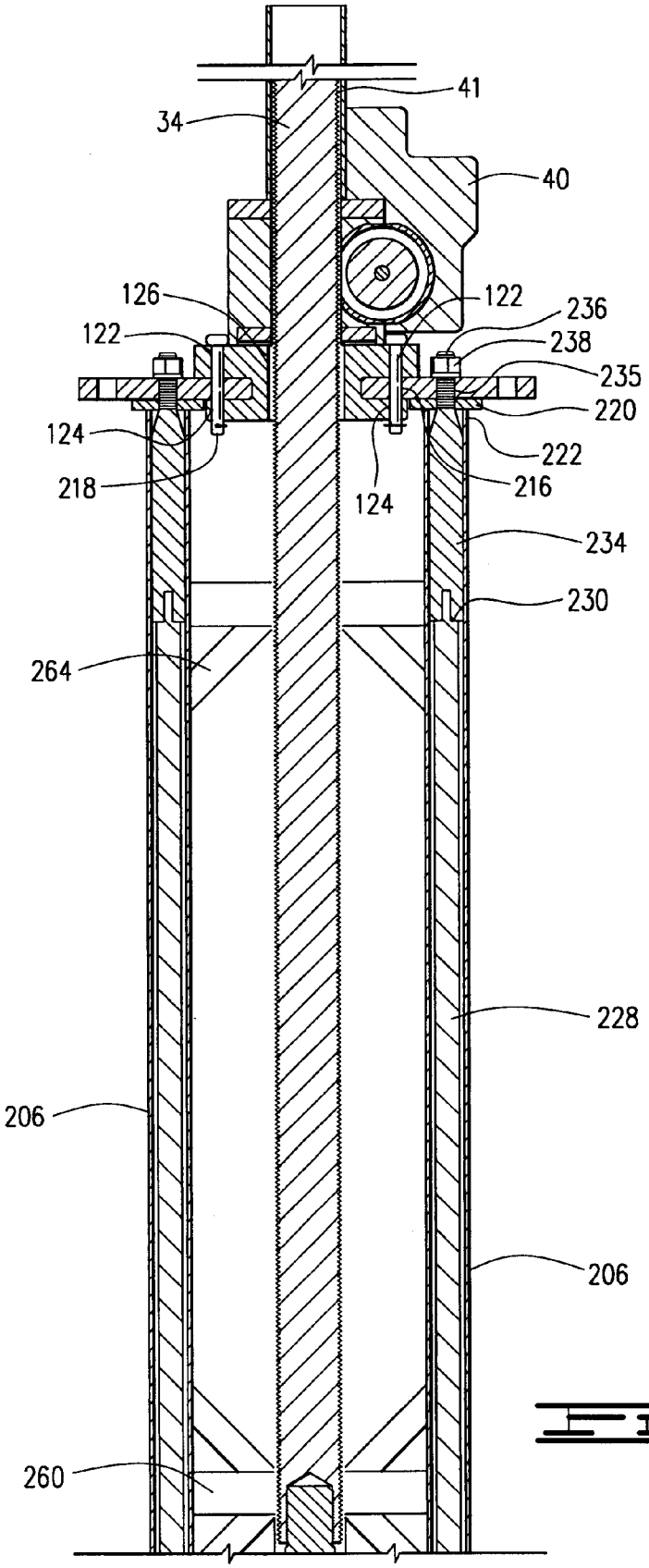
FIGS. 4A–4B are cross sections of the wellhead isolation tool of FIGS. 2A–2C showing the mandrel in a down position. The section is taken through the front legs and the mandrel.
Figure 4B:
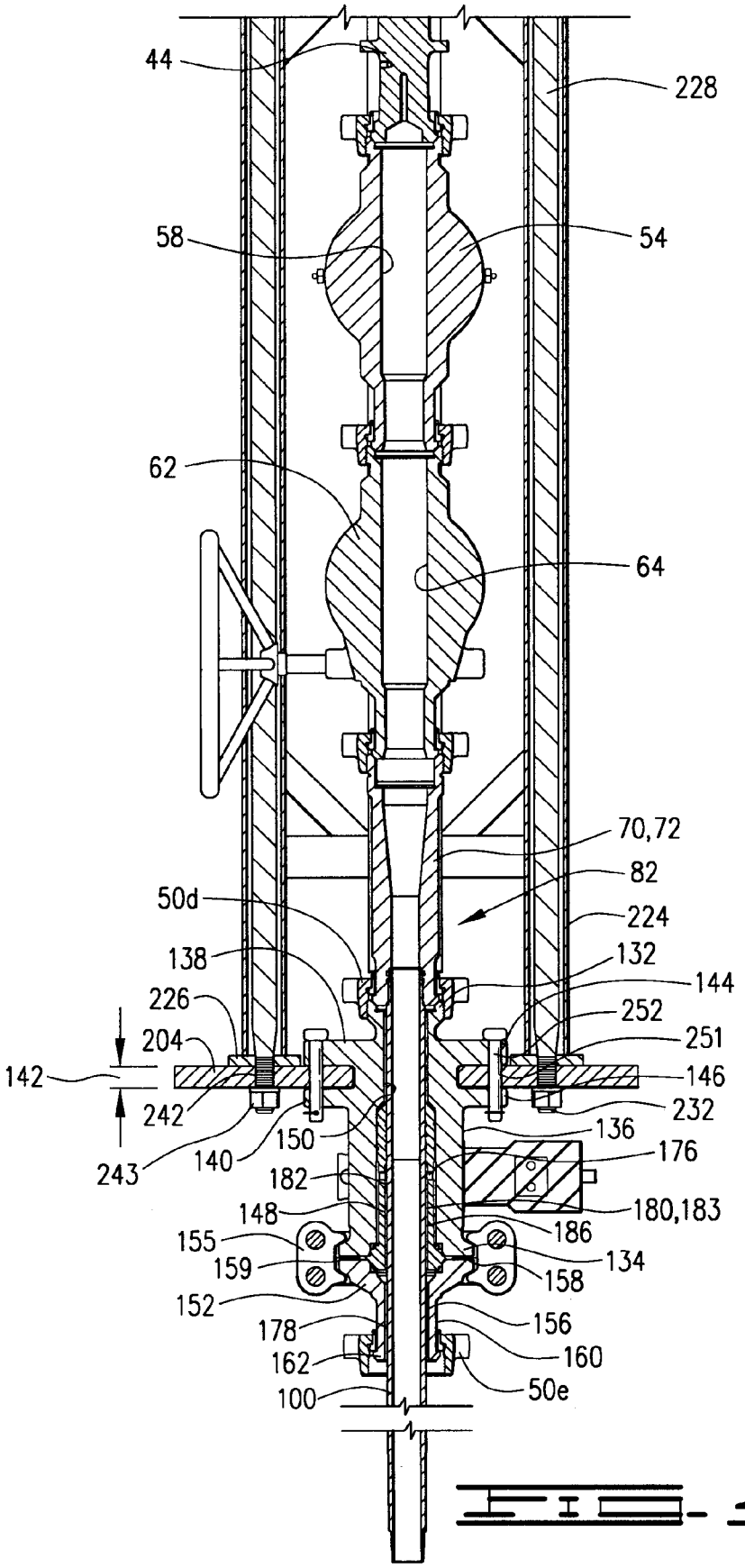

Lower valve 62 is connected at its upper end 66 to upper valve 54 with wing nut 50*b*, and is connected at its lower end 68 with a wing nut 50*c* to a mandrel assembly 70. Mandrel assembly 70 has a longitudinal central axis 71 and comprises an upper mandrel 72 and a lower mandrel 74. Longitudinal central axis 71 and longitudinal central axis 35 are collinear, such that drive rod 34 and mandrel assembly 70 have a common longitudinal axis and are thus coaxial. Upper mandrel 72 is connected at its upper end 76 to wing nut 50*c* at the lower end 68 of lower valve 62. A wing nut 50*d* is disposed about lower end 78 of upper mandrel 72. Mandrel assembly 70 may be reciprocated between an upper position 80 as shown in FIGS. 2A–2C, to a lower position 82 as shown in FIGS. 4A–4B. In upper position 80, wing nut 50*d* disposed about the lower end of 78 of upper mandrel 72 is not connected to any other part. In lower position 82, however, wing nut 50*d* is connected to a lower central support, as will be explained in more detail hereinbelow.

Lower mandrel 74 has an upper end 84 connected to upper mandrel 72 at threaded connection 86. An O-ring seal 88 may be disposed above threaded connection 86 to provide a sealed connection between the upper and lower mandrels 72 and 74. Lower mandrel 74 has a lower end 90. Lower end 90 is connected to a sealing device 91 as shown in FIG. 8. Sealing device 91 may comprise a cup mandrel 92 with a cup seal 93 connected thereto. A shoe 94 is disposed about cup mandrel 92. A diffuser, like that shown in U.S. Pat. No. 4,262,743, the details of which are incorporated herein by reference, may also be used. Mandrel assembly 70 defines a passageway 96 for the flow of substances such as treating fluids or other fluids therethrough. Passages 58, 64 and passageway 96 thus define a longitudinal central flow passage 98 which provides for flow therethrough into production tubing 32. Lower mandrel 74 has an outer surface 100.

Wellhead isolation tool 10 further includes upper and lower central supports 110 and 112 respectively, which may also be referred to as upper and lower hubs 110 and 112. Upper central support 110 comprises a body portion 114 and upper and lower flanges 116 and 118, respectively, extending outwardly from body portion 114. Upper and lower flanges 116 and 118 define a space 120 therebetween. Upper and lower flanges 116 and 118 are preferably circular flanges. Screwjack 39 and motor 40, or other means for vertically displacing drive rod 34, may be mounted by any means known in the art to upper flange 116. Upper and lower flanges 116 and 118 define pin receiving holes 122 and 124, respectively. Pin receiving holes 122 and 124 are aligned with one another. Upper central support 110 defines an opening 126 therethrough which allows drive rod 34 to reciprocate between its upper and lower positions 80 and 82, respectively.

Wellhead isolation tool 10 also comprises lower central support 112. Lower central support 112 has an upper end 132 and a lower end 134. Upper end 132 preferably has a threaded outer surface so that in the lower position 82 of mandrel assembly 70, wing nut 50*d* may be threadedly connected thereto to connect upper mandrel 72 to lower central support 112, and fix mandrel assembly 70 in lower position 82. Lower central support 112 includes a body portion 136 and has upper and lower flanges 138 and 140 extending radially outwardly therefrom. Upper and lower flanges 138 and 140 define a space 142 therebetween. Upper flange 138 has a plurality of pin receiving holes 144 defined therethrough and lower flange 140 has a plurality of pin receiving holes 146 defined therethrough. Pin receiving holes 144 and 146 are aligned with one another. Lower central support 112 includes a sleeve 148. Lower central support 112 defines a central opening 150 to allow lower mandrel 74 to pass therethrough and be moved vertically in and out of wellhead 15. A wellhead adapter 152 is connected to lower central support 112 at its lower end 134. Wellhead adapter 152 is connected to lower central support 112 with a clamp 154 which may comprise two clamp portions 155 bolted together, or which may comprise any type of clamp known in the art.

Sleeve 148 extends downwardly into a central opening 156 defined by wellhead adapter 152. Sleeve 148 has a flange 158 positioned between lower central support 112 and wellhead adapter 152. A gap 159 thus exists between wellhead adapter 152 and lower central support 112. Sleeve 148 is held in place in lower central support 112 by wellhead adapter 152 which is connected to lower central support 112 with clamp 154. Sleeve 148 is a removable sleeve such that sleeves having any desired inner diameter may be utilized to accommodate mandrels of different outer diameters. Wellhead adapter 152 comprises a wellhead adapter housing 160 having a wing nut 50*e* connected to a lower end 162 thereof.

Figure 5:
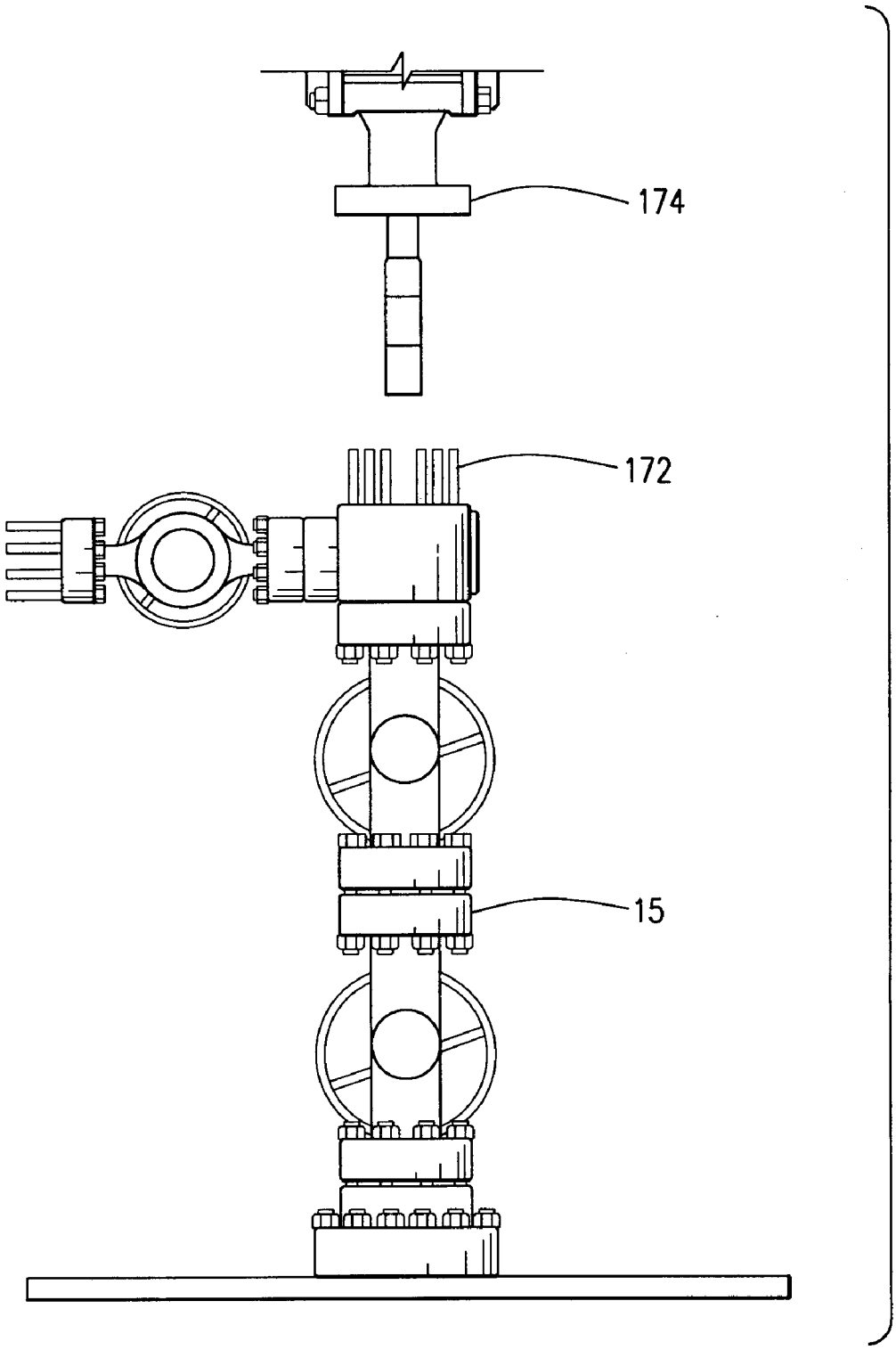
FIG. 5 PRIOR ART
FIG. 5 shows a prior art connection between a wellhead isolation tool and the wellhead.
Figure 5:
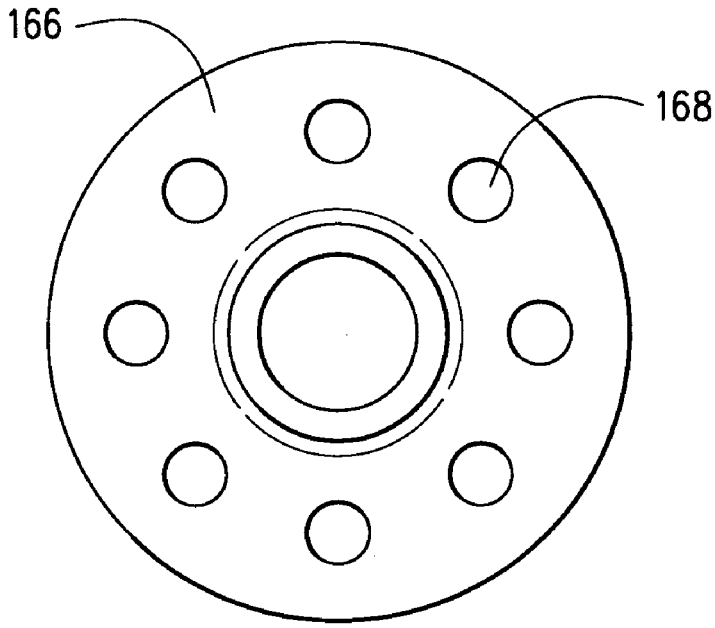
Figure 7:
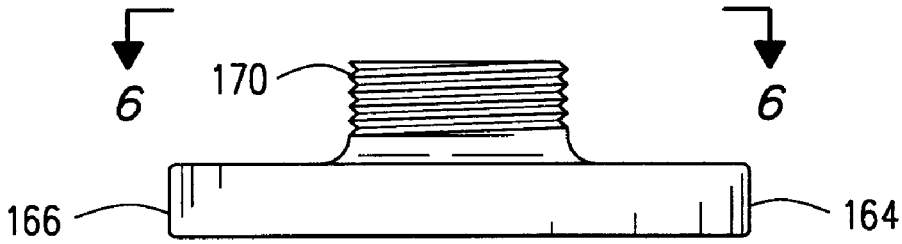
FIG. 7 is a side view of the wellhead adapter sub of the present invention.

Wellhead isolation tool 10 may further comprise a wellhead adapter sub 164 as shown in FIGS. 6 and 7. Wellhead adapter sub 164, which may be also referred to as mounting sub 164, comprises a mounting plate 166 having a plurality of bolt or pin holes 168 therethrough. A threaded neck 170 extends upwardly from mounting plate 166. A prior art wellhead 15 is depicted in FIG. 5 and, as shown therein has a plurality of bolts 172 extending upwardly therefrom in a defined bolt pattern. Bolt holes 168 in wellhead adapter sub 164 are adapted to match the pattern of bolts 172 so that wellhead adapter sub 164 may be mounted to wellhead 15 simply by placing wellhead adapter sub 164 thereon and threading nuts onto the bolts 172 extending upwardly on wellhead 15. As shown in FIG. 2C, wing nut 50*e* may be connected to wellhead adapter sub 164 simply by threading wing nut 50*e* thereon, thus connecting wellhead adapter 152 to wellhead 15. Prior art wellhead isolation tools included a wellhead adapter 174 that had mating holes to connect directly to the bolts 172 as shown in FIG. 5.

The wellhead isolation tool 10 of the present invention provides for easier connection and disconnection of the wellhead isolation tool 10 on any wellhead 15, including those with differing bolt patterns, since a plurality of wellhead adapter subs 164 may be designed having different bolt patterns to match the bolt patterns on different wellheads. The wellhead adapter sub 164 can be placed on the wellhead 15 prior to the time the wellhead isolation tool 10 is to be connected thereto which will provide for easier connections that can be made in less time, since the wellhead adapter 152 can simply be threaded to wellhead adapter sub 164.

Sleeve 148 has openings 176 therethrough. An annulus 178 is defined between outer surface 100 of lower mandrel 74 and wellhead adapter 152. Likewise, an annulus 180 exists between the outer surface 100 of lower mandrel 74 and an inner diameter 182 defined by sleeve 148. Inner diameter 182 defines a portion of central opening 150 in lower central support 112. Annulus 178 and annulus 180 define a fluid path 183 that is communicated with an annulus 184 through openings 176. Annulus 184 is defined between an outer diameter 186 of sleeve 148 and inner diameter 188 of body portion 136 of lower central support 112. When lower mandrel 74 is inserted through wellhead 15 into well 20, fluid can pass from a relief valve 190, through openings 176, annulus 178 and annulus 180 to urge cup seal 93 inwardly so that it will not engage production tubing 32 as it is lowered therethrough. Once the wellhead isolation tool 10 reaches its desired location, fluid flow through relief valve 190 ceases, and in operation, the cup seal 93 will expand to engage production tubing 32 as shown in FIG. 8. Although in the embodiment shown, the sealing device 91 engages production tubing 32, the mandrel assembly 70 and sealing device 91 can be used to seal other tubular elements, such as casing 30 in the well 20.

Wellhead isolation tool 10 includes a support structure 200. Support structure 200 includes an upper support plate 202, a lower support plate 204 and a plurality of vertical support members, such as support legs 206. In the embodiment shown, support structure 200 includes four support legs 206.

Upper support plate 202 has forward and rear edges 208 and 210 respectively and side edges 212. Upper support plate 202 has a cutout 214 which may be referred to as a semicircular or generally U-shaped cutout 214 on the forward edge 208 thereof. The U-shaped cutout 214 is adapted to be received in space 120 about body portion 114 of upper central support 110. Upper support plate 202 has a plurality of openings 216 defined therethrough. Openings 216 are positioned to align with pin receiving holes 122 and 124 so that connectors, such as pins 218, may be inserted therethrough to mount upper central support 110 to upper support plate 202. One or more pins 218 may be utilized. Support legs 206 are connected to upper support strips 220, preferably by welding or other means known in the art, at upper end 222 thereof. Support legs 206 likewise have a lower end 224. Support legs 206 are connected by welding or other means known in the art at lower end 224 to lower support strips 226, which may be identical to upper support strips 220. Support legs 206 have tension rods 228 disposed therein. In the embodiment shown, each of four support legs 206 has a tension rod 228 therein. If desired, tension rods 228 may be included only in the two support legs 206 at the front 12 of wellhead isolation tool 10. Tension rods 228 have an upper end 230 and a lower end 232. Upper end 230 is threadedly connected to a tension rod connecter 234 which extends upwardly in support legs 206 through upper support strips 220 and openings 235 defined in upper support plate 202. Tension rod connectors 234 have an upper end 236 which is threaded so that nuts 238 may be threaded thereon thus connecting support legs 206 and tension rods 228 to upper support plate 202. A nut and bolt arrangement 239 may be utilized to further connect upper support strips 220 to upper support plate 202.

Lower end 232 of tension rod 228 is threaded. Tension rods 228 extend through openings defined in lower support strips 226 and through openings 242 defined in lower support plate 204. Nuts 243 are threaded on lower ends 232 of tension rods 228 to connect tension rods 228 and thus support legs 206 to lower support plate 204.

Lower support plate 204 has a forward edge 244, a rear edge 246 and side edges 248. Forward edge 244 has a semicircular or generally U-shaped cutout 250 so that lower support plate 204 may be received in space 142 between the upper and lower flanges 138 and 140 of lower central support 112. Upper and lower support plates 202 and 204 may be identical and thus interchangeable. Lower support plate 204 has a plurality of openings 251 positioned to align with pin receiving holes 144 in upper flange 138 and pin receiving holes 146 in lower flange 140 so that pins 252 may be inserted therethrough to mount lower support plate 204 to lower central support 112. One or more pins 252 may be utilized and may be held in place with a cotter pin or by other means known in the art.

Support structure 200 has a forward, or front 253, and a back or rear 254, corresponding to the front and rear 12 and 14 of wellhead isolation tool 10, and has sides 256. Support structure 200 further includes a plurality of rear cross braces 260. The embodiment shown includes three rear cross braces 260 that extend between two support legs 206 at the rear 254 of support structure 200. Rear cross braces 260 may be connected by welding or by other means known in the art.

Wellhead isolation tool 10 may also include side cross braces 262 at the sides 256 of the well isolation tool 10. Side cross braces 262 may be connected by welding or otherwise and extend from the support legs 206 at the front 253 of support structure 200 to the support legs 206 at the rear 254 of support structure 200. Support structure 200 may also include rear angle braces and side angle braces 264 and 266, respectively, at locations where rear and side cross braces 260 and 262 are mounted. Rear and side angle braces 264 and 266 may be welded or otherwise connected to support legs 206 and to the rear and side cross braces 260 and 262 respectively.

Support structure 200 likewise includes a guide beam 268. Guide beam 268 essentially comprises an I-beam having a center section 270, rear flanges 272 and forward flanges 274 extending from center section 270. Guide beam 268 is mounted to rear cross braces 260 by welding or other means known in the art. Guide beam 268 has an upper end 276 and a lower end 278. Guide beam 268 has a pair of forward flanges 274 which may be referred to as first and second forward flanges 280 and 282 respectively.

Figure 11:
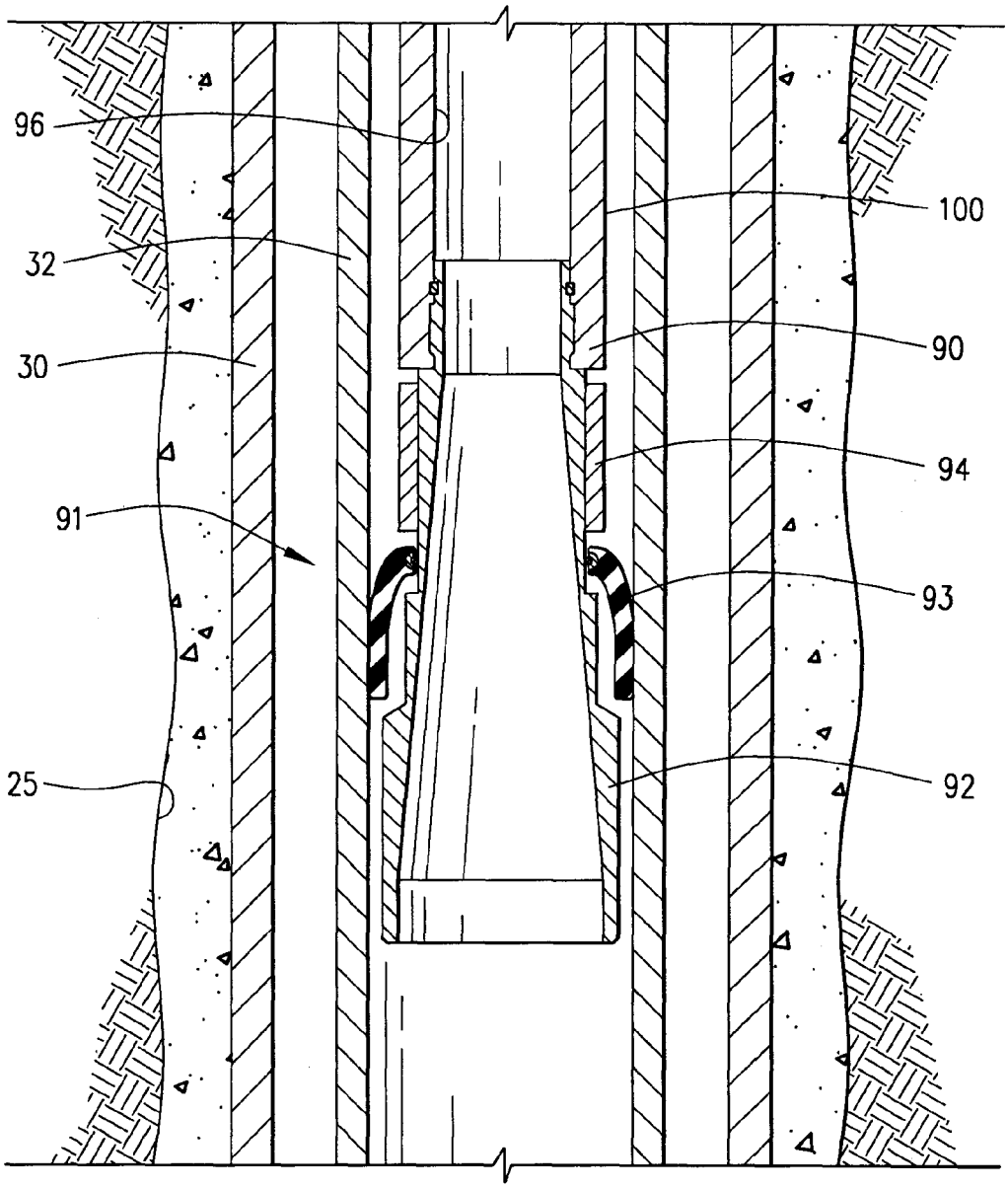
FIG. 11 shows a view from line 11—11 of FIG. 10.
Figure 9:
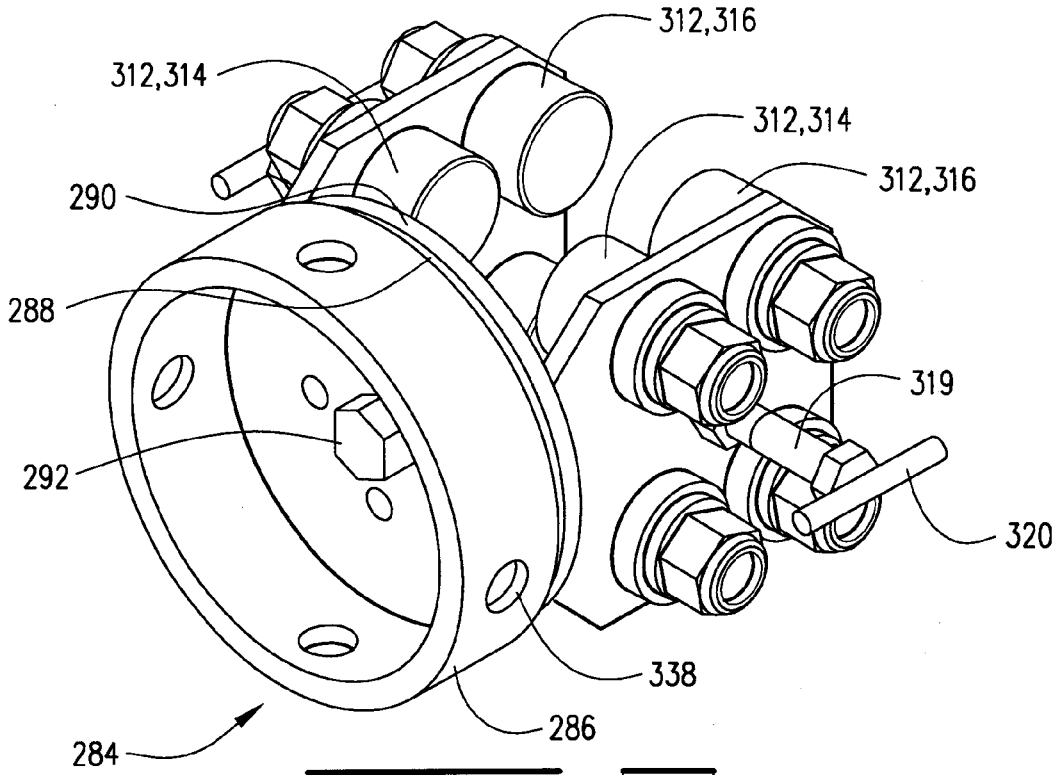
FIG. 9 shows a perspective view of the roller assembly of the present invention.
Figure 10:
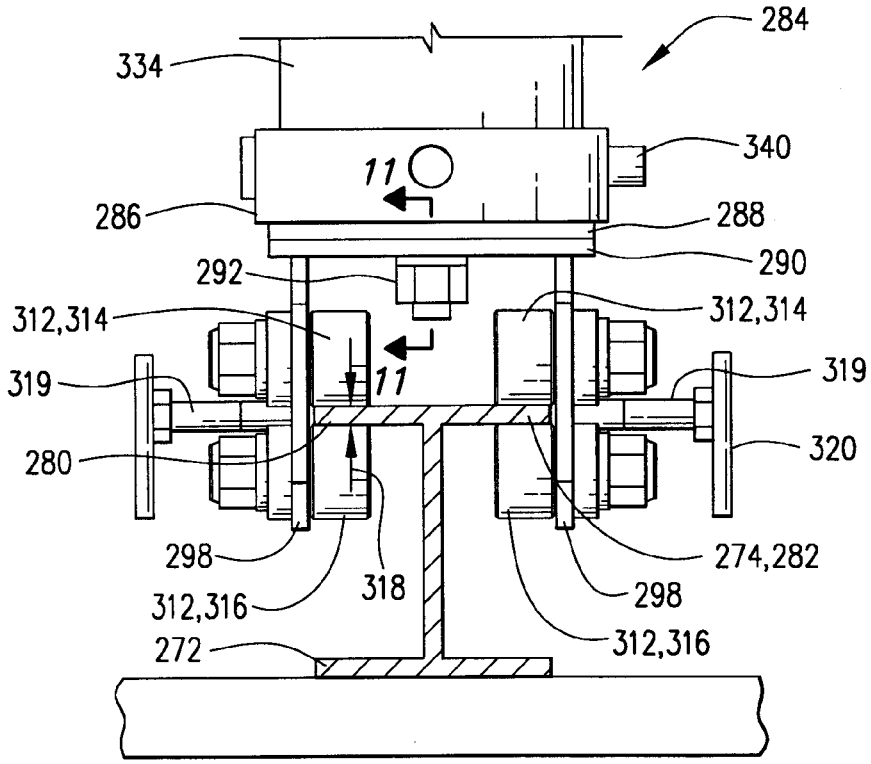
FIG. 10 is a view from line 10—10 of FIG. 3A.
Figure 11:
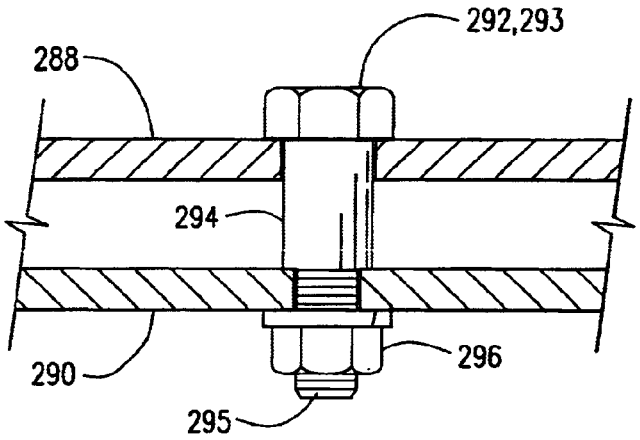
Figure 12:
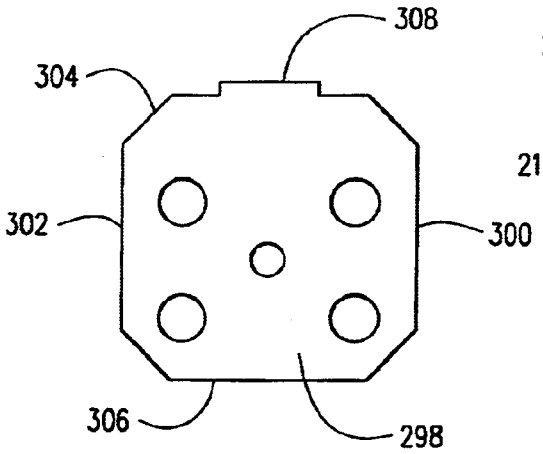
FIG. 12 is a detail showing a roller plate of the present invention.
Figure 13:
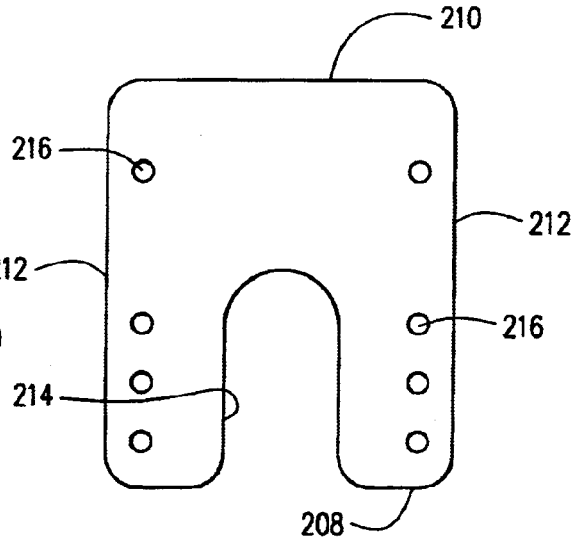
FIG. 13 is a detail showing a support plate of the present invention.
Figure 14:
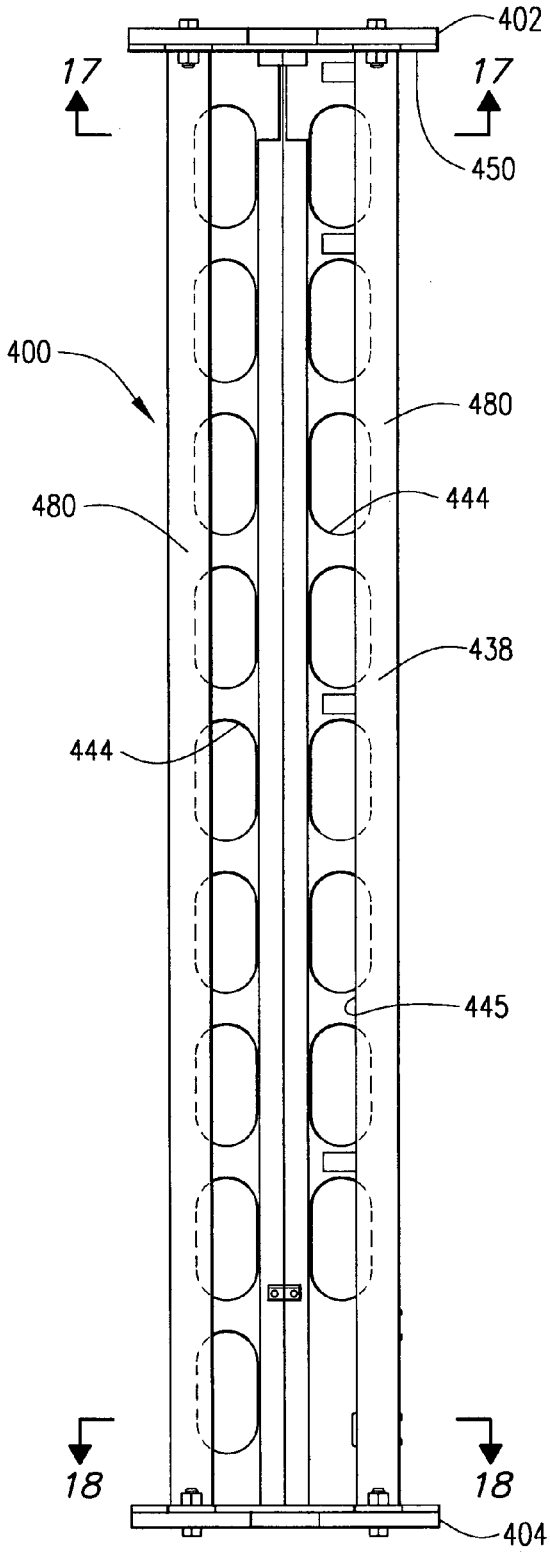
FIG. 14 is a front view of an alternative embodiment of a support structure of the present invention.
Figure 15:
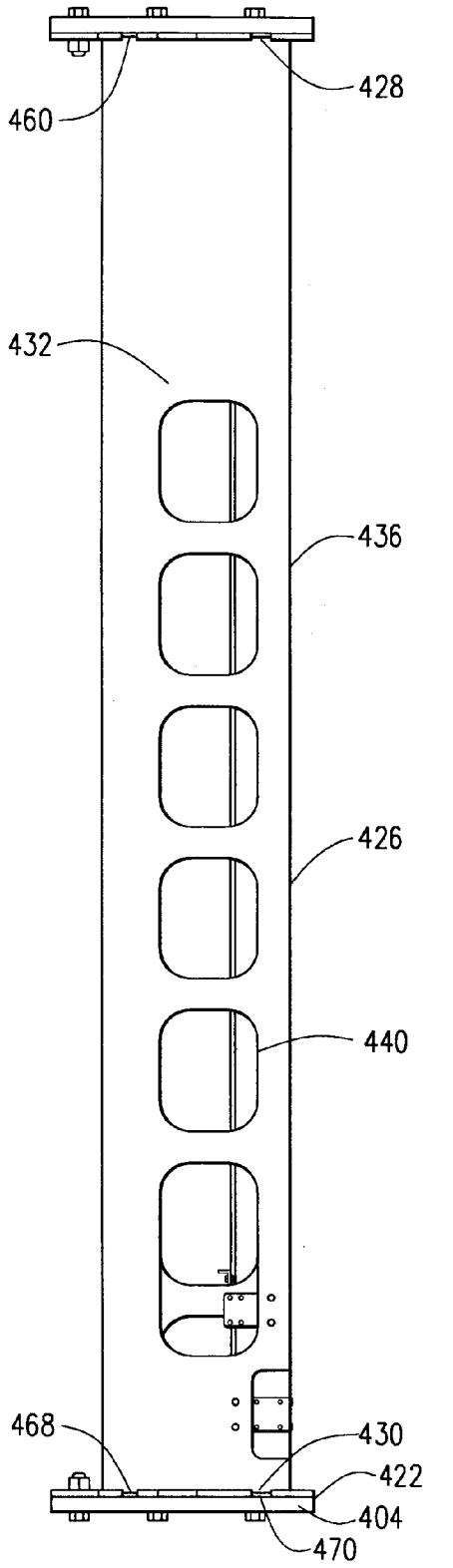
FIG. 15 is a left-side elevation view of the support structure of FIG. 14.
Figure 15:
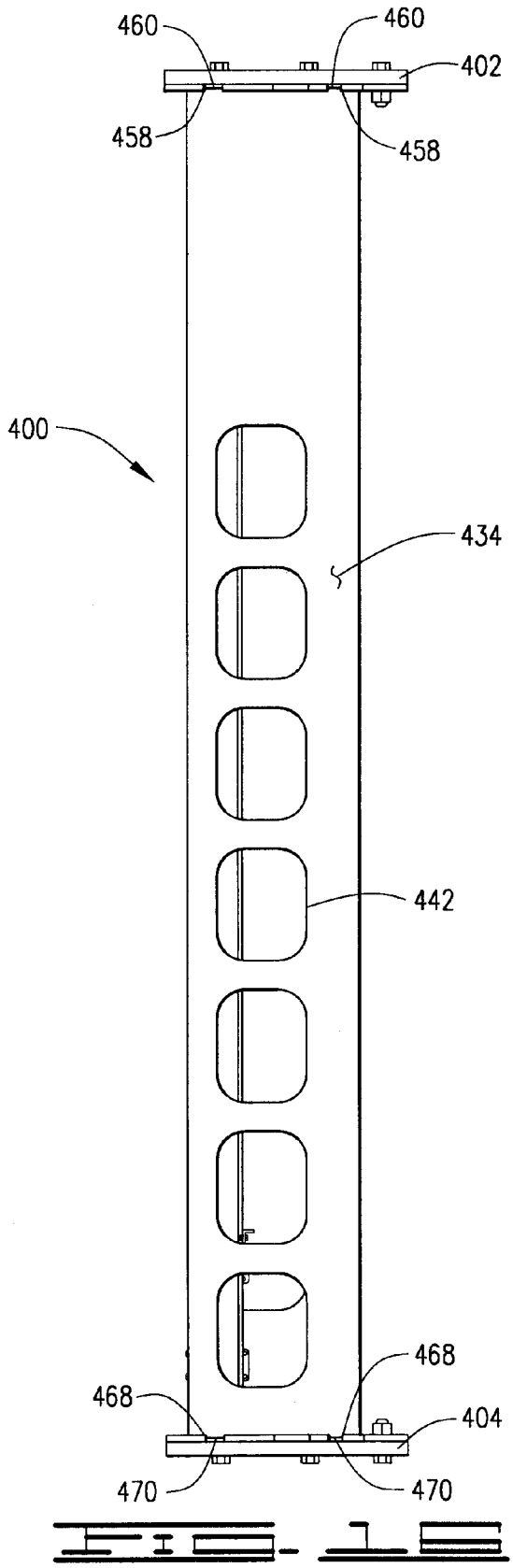
Figure 17:
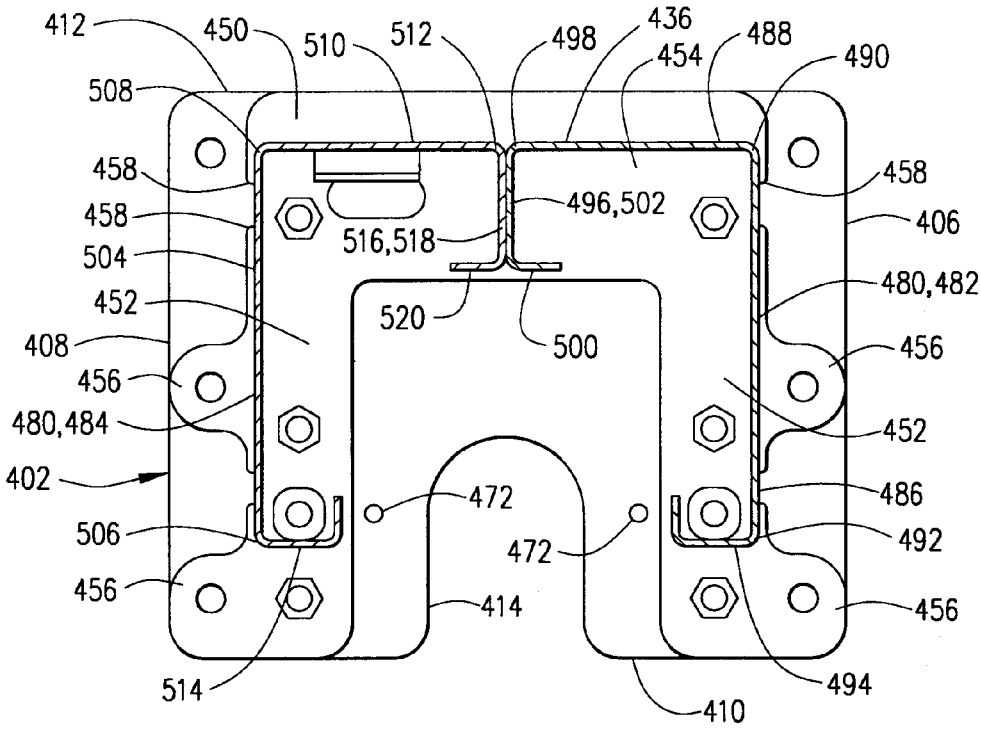
FIG. 17 is a view from line 17—17 of FIG. 14, rotated 180°.
Figure 18:
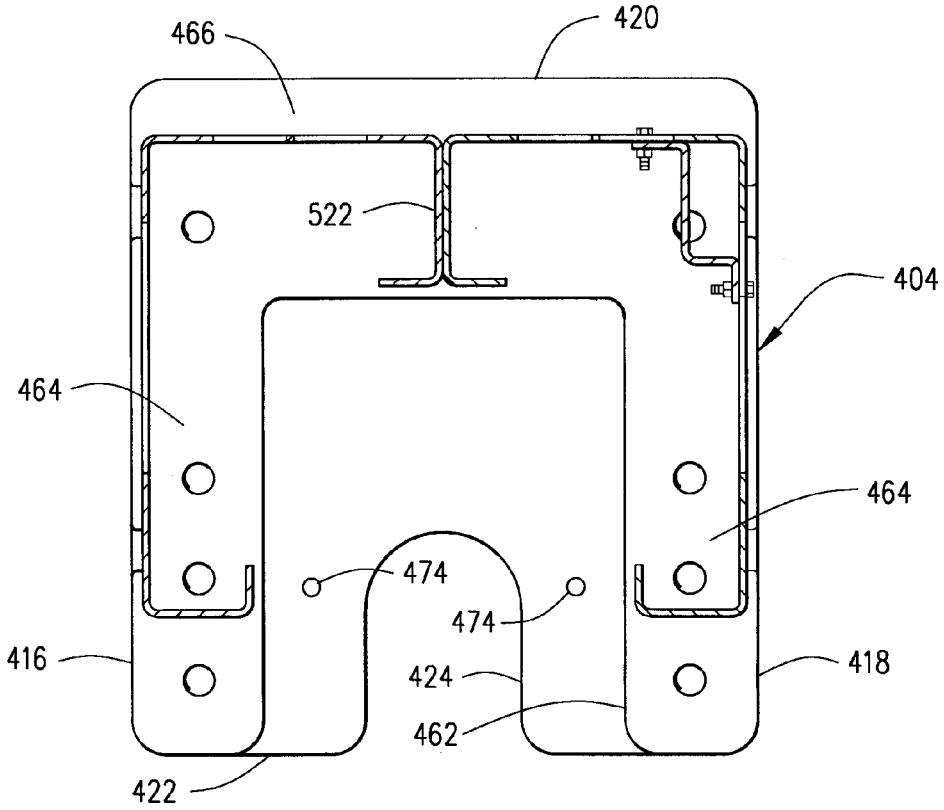
FIG. 18 is a view from line 18—18 of FIG. 14.

Wellhead isolation tool 10 further includes a roller assembly 284. A perspective view of roller assembly 284 is shown in FIG. 9. Roller assembly 284 includes a base 286 which is preferably a circular base, having a cap 288 rigidly connected thereto by welding or other means known in the art as shown in FIG. 10. Roller assembly 284 also includes a mounting plate 290, which is rotatably mounted to cap 288, with a nut and bolt arrangement 292, and can be rotatably mounted thereto by any means known in the art. For example a hexagon socket head shouldered screw may be utilized to provide the necessary rotation. FIG. 11 shows a bolt 293 with a shoulder 294 extending through cap 288. Threads 295, which are smaller than shoulder 294, extend through mounting plate 290, and a nut 296 is threaded thereon. Such an arrangement will allow rotation of cap 288 and base 286, relative to mounting plate 290. Roller assembly 284 includes a pair of roller plates 298, a detail of which is shown in FIG. 12. Roller plates 298 have first and second sides 300 and 302 and front and rear edges 304 and 306. A tang 308 extends from front edge 304 and may be received in corresponding slots (not shown) defined in mounting plate 290, so that roller plates 298 may be welded or otherwise affixed to mounting plate 290.

A plurality of rollers, and in the embodiment shown four rollers 312 are mounted to each roller plate 298. Rollers 312 may be of any type known in the art, such as for example a cam follower with bearings, and are mounted by any manner known in the art. Each roller plate 298 has a pair of forward rollers 314 and rear rollers 316. A space 318 is defined between front and rear rollers 314 and 316, respectively. First and second forward flanges 280 and 282 of guide beam 268 are received between forward and rear rollers 314 and 316. A bolt 319 with an arm 320 is likewise attached to each roller plate 298. Bolt 319 can be threaded through roller plates 298.

Roller assembly 284 may be connected to one of upper or lower valves 54 or 62 and in the embodiment shown is connected to both of upper and lower valves 54 and 62. An adjustable nut 330 of a type known in the art may be threaded into a threaded cavity 332 in the rear side of upper valve 54 and lower valve 62. Adjustable nut 330 has a head portion 334 that extends from cavity 332. Head portion 334 has openings 336 defined therethrough. Openings 336 are aligned with openings 338 in base 286 of roller assembly 284. Pins 340 may be inserted through openings 336 and 338 to connect upper and lower valves 54 and 62 to roller assembly 284.

Roller assembly 284 will initially be positioned so that first and second forward flanges 280 and 282 on guide beam 268 are positioned between the forward and rear rollers 314 and 316, respectively. Base 286 can be rotated so that openings 338 will align with openings 336 to allow pins 340 to be inserted therethrough.

The operation of the well isolation tool may be described as follows. Well isolation tool 10 is first positioned over a wellhead 15. A wellhead adapter sub 164 is connected to the upper end of wellhead 15. Wellhead isolation tool 10 is lowered with the mandrel assembly 70 in its upper position 80, so that wing nut **50*e* may be threaded onto wellhead adapter sub 164. Prior to the time wellhead isolation tool 10 is connected to wellhead 15, valves 342 and 344 on wellhead 15 are closed. Likewise, upper and lower valves 54 and 62 on wellhead isolation tool 10 are closed to prevent flow therethrough. Once the wellhead isolation tool 10 is connected to wellhead 15, valves 342 and 344 are opened. Motor 40 can then be actuated to urge drive rod 34 downwardly which in turn moves mandrel assembly 70 downwardly. Lower mandrel 74 is thus moved downwardly through longitudinal passage 17 in wellhead 15 and into well 20. More specifically, sealing device 91 connected to lower mandrel 74 is sealingly received in a tubular element in well 20, which is preferably production tubing 32**, but which may be a casing.

Once sealing device 91 sealingly engages production tubing 32, wing nut **50*d* is connected to upper end 132 of lower central support 112, and support structure 200 can be removed. All that is required is to simply disconnect wing nut 50*a* from upper valve 54 and to remove pins 252 and pins 340. Prior to removing pins 340, bolts 319 can be rotated to engage first and second forward flanges 280 and 282 to hold roller assemblies 284 in place on guide beam 268 when the support structure 200 is removed. Lower support plate 204 can then simply be removed from between upper and lower flanges 138 and 140 on lower central support 112 and the support structure 200** can be moved as a unit.

A flow line of a type known in the art (not shown) can then be connected to upper valve 54. Upper valve 54 and lower valve 62 can be opened to allow fluids or other substances to be flowed therethrough at high pressures through lower mandrel 74 into production tubing 32 and into a hydrocarbon containing formation therebelow. When the fracturing or other treatment is complete, wellhead isolation tool 10 provides for easy removal. Upper and lower valves 54 and 62 are closed after the treatment is complete. The fluid line is then disconnected from upper valve 54 and the support structure 200 is reconnected simply by positioning lower support plate 204 in space 142 and reconnecting wing nut **50*a* to upper valve 54. Pins 252 are reinserted, as are pins 340 in roller assembly 284, and wing nut 50*d* is disconnected from lower central support 112. Motor 40 can then be actuated to cause drive rod 34 to move upwardly which will, because the wing nut 50*a* has been reconnected to upper valve 54, cause mandrel assembly 70 to be lifted upwardly until the lower end 90 of lower mandrel 74 and sealing device 91 are moved above valves 342 and 344. Valves 342 and 344 are closed after lower mandrel 74 is removed therefrom. Once valves 342 and 344 are closed, the mandrel assembly can be moved to its upper position 80. Wellhead isolation tool 10 can be removed simply by disconnecting wing nut 50*e* and moving wellhead isolation tool 10 as a unit away from wellhead 15**.

In the embodiment shown in FIGS. 1–13, wellhead isolation tool 10 includes a support structure 200. An alternative embodiment of a support structure generally designated by the numeral 400 is shown in FIGS. 14–18. Support structure 400 includes upper support plate 402 and lower support plate 404. The upper and lower support plates 402 and 404, respectively, may be identical to upper and lower support plates 202 and 204, respectively. Upper plate 402, therefore, has left and right sides, or edges 406 and 408 and front and rear edges 410 and 412. Front edge 410 defines a generally U-shaped or semicircular cutout 414. Lower support plate 404 has a left edge 416, a right edge 418 and a rear edge 420. Lower support plate 404 has a front edge 422 defining a generally U-shaped or semicircular cutout 424.

A vertical support member or support frame 426 has an upper end 428 and a lower end 430. Support frame 426 has a left side 432, a right side 434, a rear side or rear panel 436, and a front 438. Left side 432 has a plurality of access openings 440 defined therein. Likewise, right side 434 has a plurality of access openings 442 defined therein. Access openings 440 and 442 may be of any configuration and may be arranged in any desired patterns so as to allow access to wing nut assemblies 50, upper and lower valves 54 and 62, mandrel assembly 70 and any other parts of the wellhead isolation tool 10 to which access is desired. Rear side 436 may also have a plurality of access openings 444 defined therein. Front 438 of support frame 426 preferably defines an opening 445 extending from the upper end 428 to the lower end 430 thereof, which will also provide access to upper and lower valves 54 and 62 and other parts of the wellhead isolation tool 10. Thus, a cross section of support frame 426 defines a generally rectangular periphery.

Support structure 400 may include an upper mounting plate 450. Upper mounting plate 450 may include side mounting strips 452 connected by a rear mounting strip 454. Upper mounting plate 450 may further include ears 456 extending from side mounting strips 452. Upper mounting plate 450 is connected to upper support plate 402 with bolts or other connectors known in the art. Screwjack 39 and motor 40, or other mechanism to move drive rod 34 may be mounted to upper support plate 402.

Upper mounting plate 450 may have notches 458 for receiving tangs 460 at the upper end of support frame 426. Support frame 426 is preferably welded at the upper end 428 thereof to upper mounting plate 450.

Support structure 400 may also include a lower mounting plate 462 which includes side mounting strips 464 and a rear mounting strip 466 extending between and connecting side mounting strips 464. Lower mounting plate 462 may be connected to lower support plate 404 with bolts or other connectors known in the art.

Lower mounting plate 462 may have notches or grooves 468 defined therein for receiving tangs 470 defined at the lower end 430 of support frame 426. Upper support plate 402 has a pair of openings 472 positioned identically to openings 124 in upper support plate 202. Lower support plate 404 has a pair of openings 474 positioned identically to openings 251 in lower support plate 204. Thus, support structure 400 maybe pinned to upper hub 110 and lower hub 112 in the same manner as support structure 200. In other words, pins 218 may be inserted through openings 472 and pin receiving holes 122 and 124. Likewise, pins 252 may be inserted through openings 474 and pin receiving holes 144 and 146.

Support frame 426 may comprise support frame portions or support frame halves 480. Support frame portions 480 may be referred to as first and second or left and right frame portions 482 and 484, respectively, for ease of identification. As is apparent from the drawings, first and second frame portions 482 and 484 have identical cross sections but may have access openings of different sizes and in different locations.

Left frame portion 482 may comprise a side panel 486 and a rear panel 488. Side panel 486 has a rear end 490 and a forward end 492. An L-shaped flange 494 extends inwardly from forward end 492. Likewise, an L-shaped flange 496 extends inwardly from an inner edge 498. L-shaped flange 496 comprises a foot portion 500 and a leg portion 502.

Right frame portion 484 comprises a side panel 504 having a forward end 506 and a rear end 508. A rear panel 510 extends from the rear end 508 of side panel 504. Rear panel 510 has an inner end 512. An L-shaped flange 514 is connected to and extends inwardly from forward end 506 of side panel 504. An L-shaped flange 516 is connected to and extends inwardly from inner end 512 of rear panel 510. L-shaped flange 516 has a leg portion 518 and a foot portion 520.

Bolts may be utilized to connect the first and second frame portions 482 and 484 through leg portions 502 and 518 of L-shaped flanges 496 and 516, respectively. As is apparent from the drawings, the two L-shaped flanges 496 and 516 define an I-section such that foot portions 500 and 520 may be referred to as forward flanges 500 and 520 like first and second forward flanges 280 and 282 defined by guide beam 268. Thus, the two L-shaped flanges 496 and 516 may be said to define a guide beam 522 with first and second forward flanges 500 and 520 which will be engaged by forward and rear rollers 314 and 316 in the same manner as first and second forward flanges 280 and 282. Thus, wellhead isolation tool 10 may include either support structure 200 or support structure 400. The operation of the wellhead isolation tool 10 is as described herein with both embodiments of the support structures described.

While numerous changes to the apparatus and methods can be made by those skilled in the art, such changes are encompassed within the spirit of this invention as defined by the appended claims.

What is claimed is:

1. A wellhead isolation tool for injecting substances through a wellhead into a well, the wellhead defining a longitudinal passage therethrough, the wellhead isolation tool comprising:

a mandrel defining a mandrel flow passage therethrough and having a non-threaded outer surface, the mandrel having upper and lower ends;

a sealing device at the lower end of the mandrel for sealingly engaging an element in the well;

at least one valve connected to the upper end of the mandrel, wherein the substances to be injected into the well may be communicated through the at least one valve into the mandrel flow passage when the at least one valve is in an open position;

a threaded drive rod for reciprocating the mandrel through the wellhead into and out of the well, the threaded drive rod being vertically aligned with the mandrel; and a coupling for connecting the at least one valve to the threaded drive rod.

2. The wellhead isolation tool of claim 1, wherein the sealing device comprises a cup seal.

3. The wellhead isolation tool of claim 2, wherein the sealing device further comprises a cup mandrel threadedly connected to the lower end of the mandrel, the cup seal being disposed about the cup mandrel.

4. The wellhead isolation tool of claim 1, wherein the sealing device comprises a diffuser.

5. The wellhead isolation tool of claim 1, wherein the threaded drive rod moves vertically to move the mandrel through the wellhead.

6. The wellhead isolation tool of claim 1, further comprising a drive mechanism for moving the threaded drive rod vertically to move the mandrel.

7. The wellhead isolation tool of claim 1, further comprising a support structure for supporting the mandrel and the at least one valve above the wellhead.

8. The wellhead isolation tool of claim 7, wherein the support structure comprises:

a lower support plate;

at least one support leg extending upwardly from the lower support plate; and an upper support plate connected to an upper end of the at least one support leg.

9. The wellhead isolation tool of claim 8, wherein the support structure further comprises a vertically oriented guide beam for guiding the mandrel, and wherein the wellhead isolation tool further comprises a roller assembly operably associated with the mandrel and engageable with the guide beam for guiding the mandrel and the at least one valve.

10. The wellhead isolation tool of claim 9, wherein the roller assembly is connected to the at least one valve.

11. The wellhead isolation tool of claim 8, further comprising a lower hub defining a passage therethrough, the lower support plate being connected to the lower hub when the mandrel is being reciprocated in or out of the well through the wellhead.

12. The wellhead isolation tool of claim 11, wherein the lower hub comprises a body portion and upper and lower flanges extending outwardly therefrom, the upper and lower flanges defining a space therebetween, and wherein the lower support plate is received between the upper and lower flanges.

13. The wellhead isolation tool of claim 12, wherein the lower support plate has a generally U-shaped cutout adapted to be disposed about the body portion of the lower hub.

14. The wellhead isolation tool of claim 13, wherein the lower support plate has at least one opening therethrough, and wherein the upper and lower flanges of the lower hub have corresponding openings therethrough so that a pin may be inserted through the upper and lower flanges and the lower support plate to connect the lower support plate to the lower hub.

15. A wellhead isolation tool for injecting substances through a passage defined by a wellhead into a well, the wellhead isolation tool comprising:

a mandrel defining a mandrel passage, the mandrel having an outer surface and a longitudinal central axis;

a valve connected to an upper end of the mandrel, the valve having an open and a closed position, wherein the substances to be injected may be communicated through the valve into the mandrel passage when the valve is in the open position;

a threaded drive rod positioned above the valve and operably associated therewith, so that up-and-down movement of the threaded drive rod causes the mandrel to reciprocate in and out of the well through the passage defined by the wellhead, the threaded rod being coaxial with the mandrel; and a drive mechanism for moving the threaded drive rod vertically so that the mandrel is moved in and out of the well.

16. The wellhead isolation tool of claim 15, further comprising a sealing device at a lower end of the mandrel for sealingly engaging an element in the well when the mandrel is received in the well through the wellhead.

17. The wellhead isolation tool of claim 15, wherein the drive mechanism comprises a mechanically driven screw-jack.

18. The wellhead isolation tool of claim 15, further comprising a support structure for supporting the mandrel as the mandrel is moved in or out of the well.

19. The wellhead isolation tool of claim 18, wherein the support structure comprises:

an upper support plate;

a lower support plate; and a plurality of supports legs connected at the upper ends thereof to the upper support plate and at the lower ends thereof to the lower support plate.

20. The wellhead isolation tool of claim 15, further comprising:

a wellhead adapter for connecting the wellhead isolation tool to the wellhead, the wellhead adapter having threads at a lower end thereof; and a wellhead adapter sub adapted to connect to the wellhead, the wellhead adapter sub having threads thereon for connecting to the threads on the wellhead adapter.

21. The wellhead isolation tool of claim 20, wherein the wellhead adapter sub comprises:

a mounting plate having a plurality of openings adapted to mate with a bolt pattern on the wellhead; and a threaded neck extending upwardly from the mounting plate.

22. A wellhead isolation tool for injecting substances through a wellhead into a well, the wellhead defining a longitudinal passage therethrough, the wellhead isolation tool comprising:

a mandrel defining a mandrel flow passage for the substances to be injected, the mandrel having a lower end sealingly engageable with a tubular element in the well;

at least one valve connected to an upper end of the mandrel, wherein the substances may be communicated into the mandrel flow passage when the at least one valve is in an open position;

a drive rod releasably connected to the at least one valve for reciprocating the mandrel into and out of the well through the longitudinal passage in the wellhead;

a lower hub having a passage through which the mandrel passes;

a wellhead adapter connected to the lower hub for connection to the wellhead; and a removable support structure for supporting the at least one valve and the mandrel while the mandrel is urged through the wellhead, the support structure comprising:

a lower support plate having a vertical support member extending upwardly therefrom, the lower support plate defining a plurality of openings therethrough, the lower hub having a plurality of mating openings, wherein pins may be removably inserted into the openings in the lower hub and the lower support plate, and wherein the support structure may be disconnected and removed by removing the pins and disconnecting the drive rod from the at least one valve after the wellhead adapter is connected to the wellhead.

23. The wellhead isolation tool of claim 22, wherein the wellhead adapter has threads thereon for connecting to threads on a wellhead adapter sub adapted to connect to and extend upwardly from the wellhead.

24. The wellhead isolation tool of claim 23, wherein the wellhead adapter sub has a hole pattern adapted to mate with a bolt pattern on an upper end of the wellhead.

25. The wellhead isolation tool of claim 22, wherein the lower support plate has a generally U-shaped cutout, the cutout being received about a body portion of the lower hub.

26. The wellhead isolation tool of claim 25, wherein the lower hub comprises upper and lower flanges extending radially outwardly from the body portion, and wherein the lower support plate is received between the upper and lower flanges.

27. The wellhead isolation tool of claim 25, wherein the support structure comprises an upper support plate connected to an upper end of the vertical support member, the upper support plate being identical to the lower support plate.

28. The wellhead isolation tool of claim 27, further comprising an upper hub connected to the upper support plate, wherein the drive rod passes through the upper hub.

29. A wellhead isolation tool comprising:

a mandrel for reciprocating through a wellhead into a tubular element disposed in a well below the wellhead;

a valve connected to the mandrel and movable therewith;

a wellhead adapter for connecting the wellhead isolation tool to the wellhead, wherein the mandrel is movable in the wellhead adapter; and a wellhead adapter sub, the wellhead adapter sub having a bolt hole pattern adapted to match a bolt pattern on an upper end of the wellhead, the wellhead adapter sub having a threaded upper end for mating with threads on the wellhead adapter so that the wellhead adapter sub may be bolted to the wellhead, wherein the wellhead isolation tool may be connected to the wellhead by threadedly connecting the wellhead adapter to the wellhead adapter sub.

30. The wellhead isolation tool of claim 29, wherein the threads on the wellhead adapter comprise internal threads, and wherein the threads on the wellhead adapter sub comprise external threads.

31. The wellhead isolation tool of claim 29, wherein the wellhead adapter comprises a wellhead adapter housing and a wing nut connected to a lower end of the wellhead adapter housing, the wing nut having threads defined thereon.

32. The wellhead isolation tool of claim 29, further comprising a support structure for supporting the valve and the mandrel as the mandrel is moved through the wellhead into the well.

33. The wellhead isolation tool of claim 32, wherein the support structure comprises a vertically oriented beam, and wherein the wellhead isolation tool further comprises a roller assembly engageable with the vertically oriented beam for guiding the mandrel and the valve.

34. The wellhead isolation tool of claim 33, wherein the roller assembly is connected to the valve.

35. The wellhead isolation tool of claim 29, further comprising a drive rod for vertically moving the mandrel.

36. The wellhead isolation tool of claim 35, wherein the drive rod is a threaded drive rod, and wherein the wellhead isolation tool further comprises a drive mechanism for moving the drive rod.

37. The wellhead isolation tool of claim 35, wherein the drive rod and the mandrel have a common longitudinal axis.

38. A wellhead isolation tool for injecting substances through a passage defined by a wellhead into a well, the wellhead isolation tool comprising:

a mandrel defining a mandrel flow passage for the substances to be injected, the mandrel being movable between an upper position wherein the mandrel is retracted from the wellhead and a lower position wherein a lower end of the mandrel is received in an element in the well;

a valve connected to the mandrel and movable therewith;

a drive rod connected to the valve for moving the mandrel between its upper and lower positions;

an upper hub, the drive rod being movably disposed in the upper hub;

a lower hub, the mandrel being movably disposed in the lower hub;

a wellhead adapter that connects the lower hub to the wellhead; and a support structure for supporting the mandrel as the mandrel is being inserted into or withdrawn from the well through the wellhead, the support structure comprising:

an upper support plate connectable to the upper hub;

a lower support plate releasably connectable to the lower hub; and a vertical support frame connected to the upper and lower support plates, wherein the lower support plate, the upper hub, the drive rod, and the support structure can be moved as a unit after the mandrel is moved to its lower position by disconnecting the lower support plate from the lower hub and releasing the drive rod from the valve.

39. The wellhead isolation tool of claim 38, wherein the vertical support frame comprises a plurality of vertical support legs connected to the upper and lower support plates.

40. The wellhead isolation tool of claim 38, wherein the vertical support frame has a left side, a right side, and a rear side, and wherein a plurality of access openings are defined in each of the left, right, and rear sides of the vertical support frame.

41. The wellhead isolation tool of claim 40, wherein the vertical support frame defines a generally rectangular periphery, the vertical support frame having an open front side.

42. The wellhead isolation tool of claim 40, wherein the vertical support frame comprises a pair of connected frame portions, each frame portion defining one of the left and right sides and a portion of the rear side of the vertical support frame.

43. The wellhead isolation tool of claim 42, further comprising a roller assembly connected to the valve, wherein the pair of frame portions define a vertical guide beam, and wherein the roller assembly engages the guide beam to guide the mandrel in and out of the well.

44. The wellhead isolation tool of claim 43, wherein the lower support plate may be disconnected from the lower hub, and wherein the support structure, the upper hub, and the drive rod may be moved as a unit.

45. A wellhead isolation tool for injecting substances through a passage defined by a wellhead into a well, the wellhead isolation tool comprising:

an upper hub;

a drive rod movably disposed in the upper hub;

at least one valve releasably connected to the drive rod;

a mandrel defining a flow passage positioned below the at least one valve, the at least one valve having a closed position and an open position, wherein in the open position the substances to be injected may be communicated through the at least one valve into the mandrel;

a lower hub, the mandrel being movably disposed in the lower hub;

a wellhead adapter for connecting the lower hub to the wellhead; and a support structure comprising:

an upper support plate releasably connected to the upper hub;

a lower support plate releasably connected to the lower hub; and a support frame extending between the upper and lower support plates, wherein the support frame has an outer periphery defining a generally rectangular cross section having a left side, a right side, a rear, and a front.

46. The wellhead isolation tool of claim 45, wherein the support frame defines a guide beam, wherein the wellhead isolation tool further comprises a roller assembly, and wherein the roller assembly engages the guide beam to guide the mandrel in and out of the well.

47. The wellhead isolation tool of claim 45, wherein the support frame comprises first and second frame halves connected together.

48. The wellhead isolation tool of claim 47, wherein each frame half comprises a bent metal plate.

49. The wellhead isolation tool of claim 48, wherein each frame half further comprises:

a side panel;

a rear panel;

and a generally L-shaped flange extending from an inner edge of the rear panel, wherein the L-shaped flanges define the guide beam when the frame halves are connected together.

50. The apparatus of claim 45, wherein the left and right sides and the rear of the support frame define a plurality of access opening.

* * * * *